US010418195B2

(12) United States Patent
Wong

(10) Patent No.: US 10,418,195 B2
(45) Date of Patent: Sep. 17, 2019

(54) CONTACT LEVER FOR USE IN AN ELECTRICAL SWITCH ASSEMBLY

(71) Applicants: Dongguan Chen Da Appliance Co. Ltd, Guangdong (CN); Defond Components Limited, Chai Wan (HK)

(72) Inventor: Kin Yu Wong, Chai Wan (HK)

(73) Assignee: Defond Electech Co., Ltd, Guangdong (CN)

( * ) Notice: Subject to any disclaimer, the term of this patent is extended or adjusted under 35 U.S.C. 154(b) by 0 days.

(21) Appl. No.: 15/869,794

(22) Filed: Jan. 12, 2018

(65) Prior Publication Data

US 2018/0350531 A1 Dec. 6, 2018

(30) Foreign Application Priority Data

Jun. 1, 2017 (HK) ..... 17105471
Sep. 19, 2017 (HK) ..... 17109512

(51) Int. Cl.
*H01H 5/06* (2006.01)
*H01H 3/12* (2006.01)
*H01H 13/28* (2006.01)

(52) U.S. Cl.
CPC ..... *H01H 5/06* (2013.01); *H01H 3/12* (2013.01); *H01H 13/28* (2013.01)

(58) Field of Classification Search
CPC ..... H01H 3/12; H01H 5/06; H01H 13/26; H01H 13/28; H01H 13/30; H01H 13/52
USPC ..... 200/400, 402, 408
See application file for complete search history.

(56) References Cited

U.S. PATENT DOCUMENTS 3,242,281 A 3/1966 Brevick et al.
5,171,945 A * 12/1992 Su ..... H01H 13/28 200/467
8,664,553 B2 * 3/2014 Yuba ..... H01H 13/52 200/268

(Continued)

FOREIGN PATENT DOCUMENTS

CN 201204138 Y 3/2009
CN 201788861 U 4/2011

(Continued)

*Primary Examiner* — Edwin A. Leon
*Assistant Examiner* — Lheiren Mae A Caroc
(74) *Attorney, Agent, or Firm* — K&L Gates LLP

(57) ABSTRACT

A contact lever for use in an electrical switch assembly so as to allow selectable movement within the switch assembly of a contact lever contact member from electrical connection with a first stationary contact member into electrical connection with a second stationary contact member, the contact lever including: first and second lever arms that are connected at respective first ends to the contact lever contact member; said first and second lever arms having respective second ends, and, said first and second lever arms being configured to extend away from the contact member and to terminate at their respective second ends; a gap disposed between the first and second lever arms which separates the first and second lever arms as they extend away from the contact member, and wherein the gap is configured to allow movement of a spring element of the switch assembly therethrough; and a bridge member configured for connection with the first and second lever arms so as to traverse the gap separating the first and second lever arms.

9 Claims, 8 Drawing Sheets

(56) References Cited

U.S. PATENT DOCUMENTS

| | | | | |
|---|---|---|---|---|
| 2010/0155211 | A1* | 6/2010 | Domzalski ..... | H01H 5/08<br>200/408 |
| 2012/0152714 | A1 | 6/2012 | Kishi et al. | |

FOREIGN PATENT DOCUMENTS

| | | | |
|---|---|---|---|
| CN | 201853620 | U | 6/2011 |
| CN | 202796571 | U | 3/2013 |
| CN | 203218148 | U | 9/2013 |
| CN | 203941841 | U | 11/2014 |
| JP | U4964767 | | 6/1974 |
| JP | H07153347 | A | 6/1995 |
| JP | 2008210654 | | 9/2008 |

* cited by examiner

CONTACT LEVER FOR USE IN AN ELECTRICAL SWITCH ASSEMBLY

TECHNICAL FIELD

The present invention relates to contact levers for use in electrical switch assemblies.

BACKGROUND OF THE INVENTION

In certain existing electrical switch assemblies, such as snap-action type switch assemblies, when relatively small amount of physical force is applied to an actuator member, a contact lever operably-connected with the actuator member via a tension spring will quickly and reliably lever a movable contact member from a position of electrical communication with one stationary contact member, into a position of electrical communication with another stationary contact member of the electrical switch assembly. Such electrical switch assemblies will typically utilise a contact lever upon which the movable contact is mounted to allow movement of the movable contact from electrical communication with the one stationary contact into electrical communication with the other. The contact lever will typically comprise a pair of substantially parallel lever arms separated by a gap through which the tension spring may suitably pass during operation of the electrical switch assembly. One disadvantage with contact levers of this configuration is that they tend to be susceptible to deformation in certain circumstances due to exposure to heat stress—for instance, when used in power tools such as angle grinders and the like, requiring high current rating capacity.

SUMMARY OF THE INVENTION

The present invention seeks to alleviate at least one of the above-described problems.

The present invention may involve several broad forms. Embodiments of the present invention may include one or any combination of the different broad forms herein described.

In a first broad form, the present invention provides a contact lever for use in an electrical switch assembly so as to allow selectable movement within the switch assembly of a contact lever contact member from electrical connection with a first stationary contact member into electrical connection with a second stationary contact member, the contact lever including: first and second lever arms that are connected at respective first ends to the contact lever contact member; said first and second lever arms having respective second ends, and, said first and second lever arms being configured to extend away from the contact member and to terminate at their respective second ends; a gap disposed between the first and second lever arms which separates the first and second lever arms as they extend away from the contact member, and wherein the gap is configured to allow movement of a spring element of the switch assembly therethrough; and a bridge member configured for connection with the first and second lever arms so as to traverse the gap separating the first and second lever arms.

Preferably, the bridge member may be configured for connecting the first and second lever arms at regions along the first and second lever arms so as to define an aperture between the bridge member and the contact lever contact member.

Preferably, the bridge member may include a substantially U-shaped configuration.

Preferably, the present invention may include a contact lever contact member plate having at least one of a recess, aperture or abatement disposed therein configured for securement of the contact lever contact member thereto.

Preferably, the present invention may include an aperture configured for securement with a first end of a tension spring of the switch assembly.

Preferably, the bridge member may include a conductive material.

Preferably, the bridge member may include a copper alloy material.

Preferably, the bridge member may be integrally formed with the first and second lever arms.

Preferably, the switch assembly may include a micro-switch assembly.

In another broad form, the present invention provides a contact lever for use in an electrical switch assembly so as to allow selectable movement within the switch assembly of a contact lever contact member from electrical connection with a first stationary contact member into electrical connection with a second stationary contact member, said contact lever including: first and second lever arms that are connected at respective first ends to a contact lever contact member, said first and second lever arms having respective second ends, and, said first and second lever arms being configured to extend away from the contact member and to terminate at their respective second ends; a gap disposed between the first and second lever arms which separates the first and second lever arms as they extend away from the contact member, and wherein the gap is configured to allow movement of a spring element of the switch assembly therethrough; wherein the contact lever includes a contact lever layer bonded or joined to the contact lever to form a multi-layer structure of increased cross-sectional thickness.

Preferably, the contact lever layer may include a further contact lever that is bonded or joined to the contact lever to form the multi-layer structure of increased cross-sectional thickness.

Preferably, the present invention may include a bridge member configured for connection with the first and second lever arms so as to traverse the gap separating the first and second lever arms.

Preferably, the bridge member may be configured for connecting the first and second lever arms at regions along the first and second lever arms so as to define an aperture between the bridge member and the contact lever contact member.

Preferably, the bridge member may include a substantially U-shaped configuration.

Preferably, the present invention may include a contact lever contact member plate having at least one of a recess, aperture or abatement disposed therein configured for securement of the contact lever contact member thereto.

Preferably, the present invention may include an aperture configured for securement with a first end of a tension spring of the switch assembly.

Preferably, the bridge member may include a conductive material.

Preferably, the bridge member may include a copper alloy material.

Preferably, the bridge member may be integrally formed with the first and second lever arms.

Preferably the switch assembly may include a micro-switch assembly.

In another broad form, the present invention provides an electrical switch assembly including a contact lever in accordance with any one of the features of the first broad form of the present invention.

BRIEF DESCRIPTION OF THE DRAWINGS

The present invention will become more fully understood from the following detailed description of a preferred but non-limiting embodiments thereof, described in connection with the accompanying drawings, wherein:

In FIG. 5A the contact lever is arranged so that the movable contact member mounted thereon is in electrical communication with a contact member of a Normally Closed (NC) electrical terminal and in FIG. 5B the contact lever is arranged so that the movable contact member mounted thereon is in electrical communication with a contact member of a Normally Opened (NO) electrical terminal;

DETAILED DESCRIPTION OF THE PREFERRED EMBODIMENTS

Preferred embodiments of the present invention will now be described herein with reference to FIGS. 1 to 7B of the drawings. Although embodiments of the present invention will be described in relation to use with a microswitch type electrical switch assembly (also referred to as a miniature snap-action type switch), it would be appreciated that this is for illustrative purposes only and the electrical switch assembly may not necessarily be limited to microswitch type switch assemblies.

Figure 1:
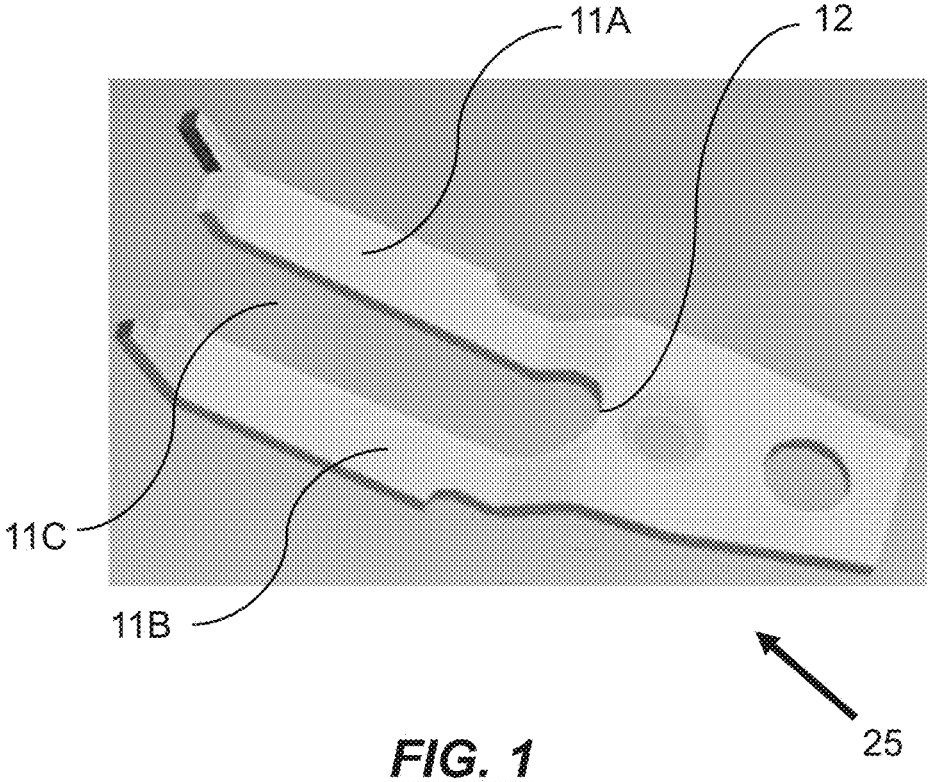
FIG. 1 shows a perspective view of a prior art contact lever for use in a microswitch assembly.
Figure 2A:
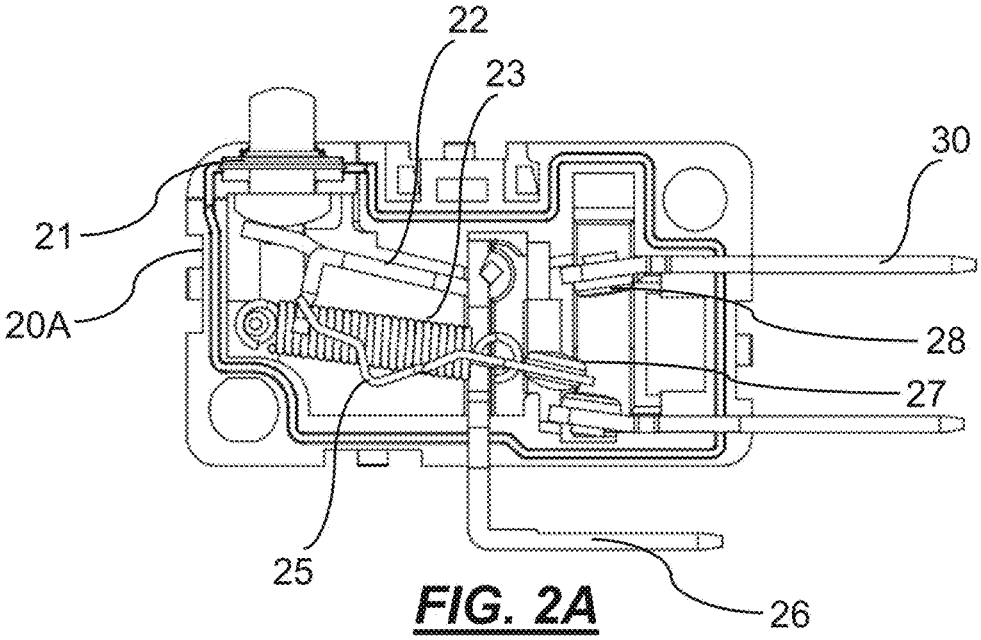
FIGS. 2A and 2B shows a side-view of a prior art microswitch assembly having a prior art contact lever arranged in a first and a second position respectively.
Figure 2B:
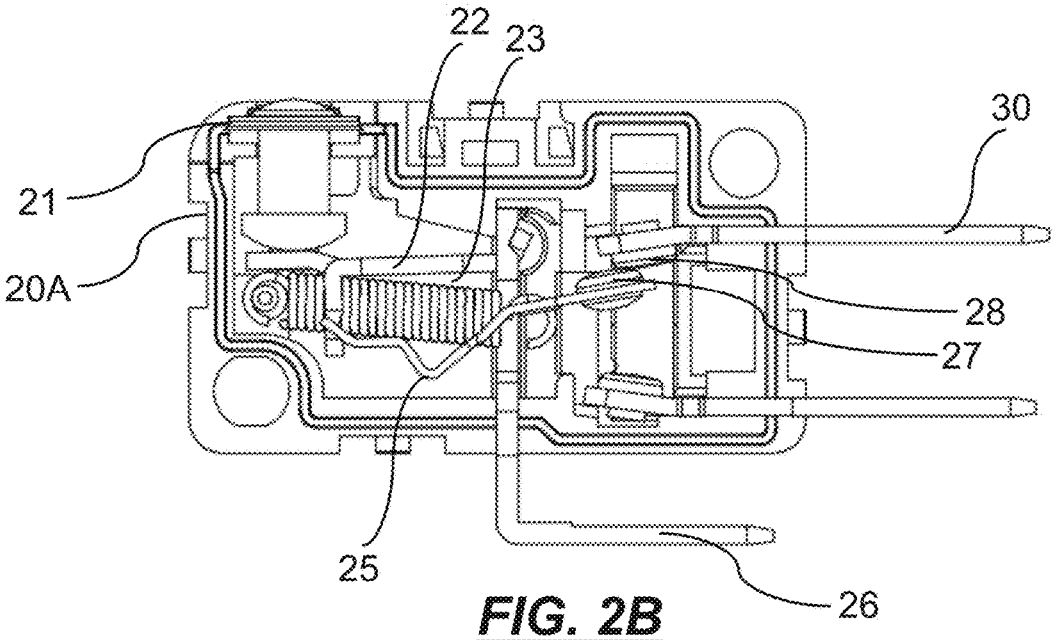
Figure 3A:
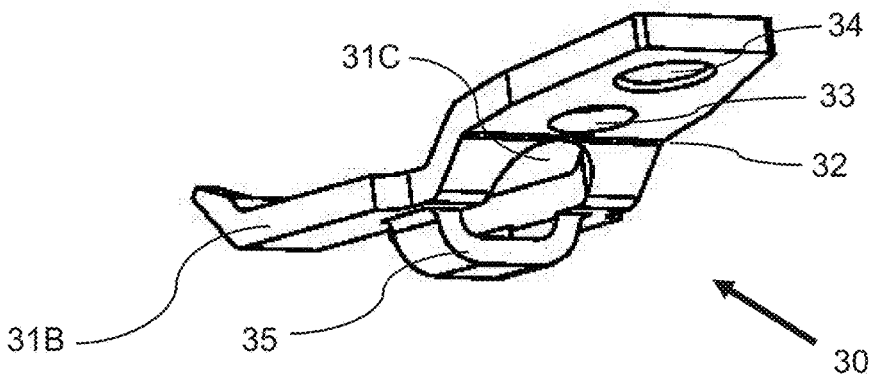
FIGS. 3A, 3B and 3C show a perspective-view, a top-view and a side-view respectively of an exemplary contact lever in accordance with an embodiment of the present invention.
Figure 3B:
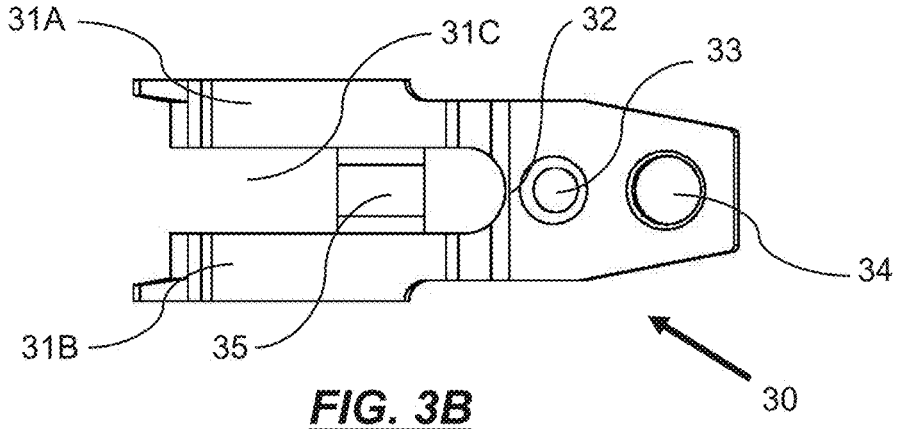
Figure 3C:
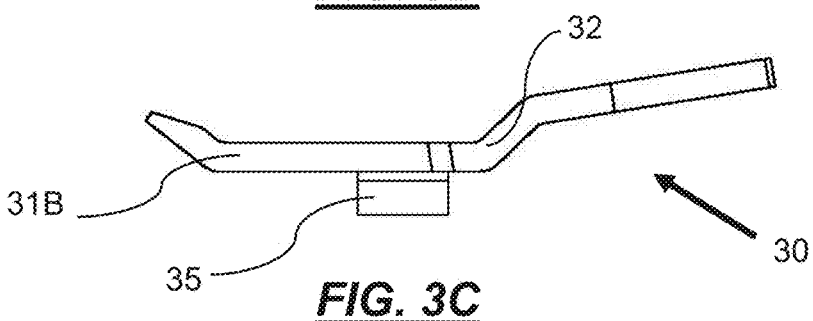

In a prior art microswitch assembly as shown in FIGS. 1-2B, when a relatively small amount of force is applied by a user's finger to an actuator member (21) to depress it inwardly of a housing (20A), a contact lever (25) operably-connected with the actuator member (21) via a yoke (22) and a tension spring (23) is caused to move a movable contact member (27) from a position of electrical communication with one stationary contact member, into a position of electrical communication with another stationary contact member (28) of the electrical switch assembly. The prior art contact lever (25) is also in fixed electrical communication with a common terminal (26) of the prior art switch assembly. The prior art contact lever (25) used in such assemblies are configured for mounting of the movable contact (27) of the electrical switch assembly at one end to allow movement of the movable contact (27) from electrical communication with the one stationary contact into electrical communication with the other. As shown in FIG. 1, the prior art contact lever (25) used in the assembly will typically comprise a pair of substantially parallel lever arms (11A,11B) separated by a gap (11C) therebetween through which the tension spring (23) is able to suitably be received when operably-connected with the contact lever and during ordinary operation of the prior art electrical switch assembly. As can be seen from FIGS. 1-2B and will be appreciated by persons skilled in the art, one disadvantage with contact levers (25) of this type of configuration and structure is that they tend to be relatively susceptible to deformation in certain circumstances, such as for instance, due to exposure to heat, temperature and/or mechanical stress—this being particularly problematic for instance, when such contact lever components are used in electrical switch assemblies of power tools such as angle grinders and the like, requiring relatively high current rating capacity.

Figure 4:
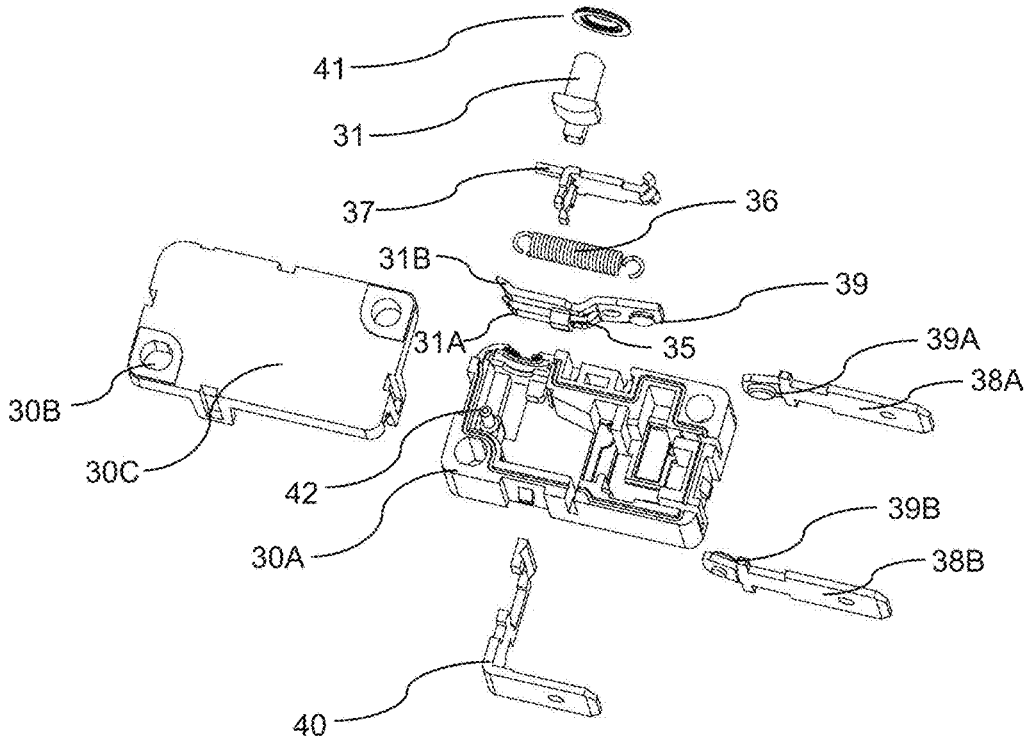
FIG. 4 shows an exploded view of an exemplary microswitch assembly in which the exemplary contact lever embodiment shown in FIGS. 3A, 3B and 3C is used
Figure 5A:
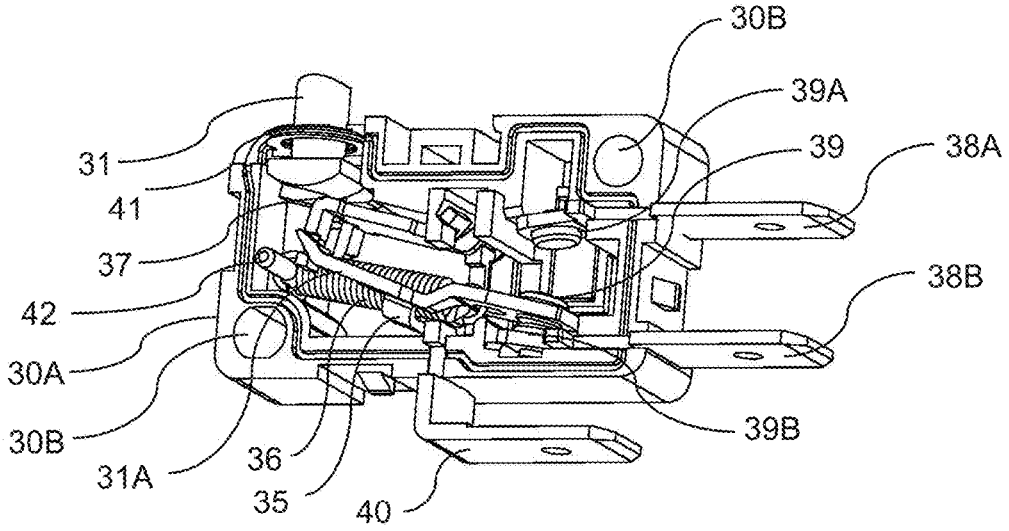
FIGS. 5A and 5B shows side-views of the exemplary microswitch assembly in which the exemplary contact lever embodiment shown in FIGS. 3A, 3B and 3C is used.
Figure 5B:
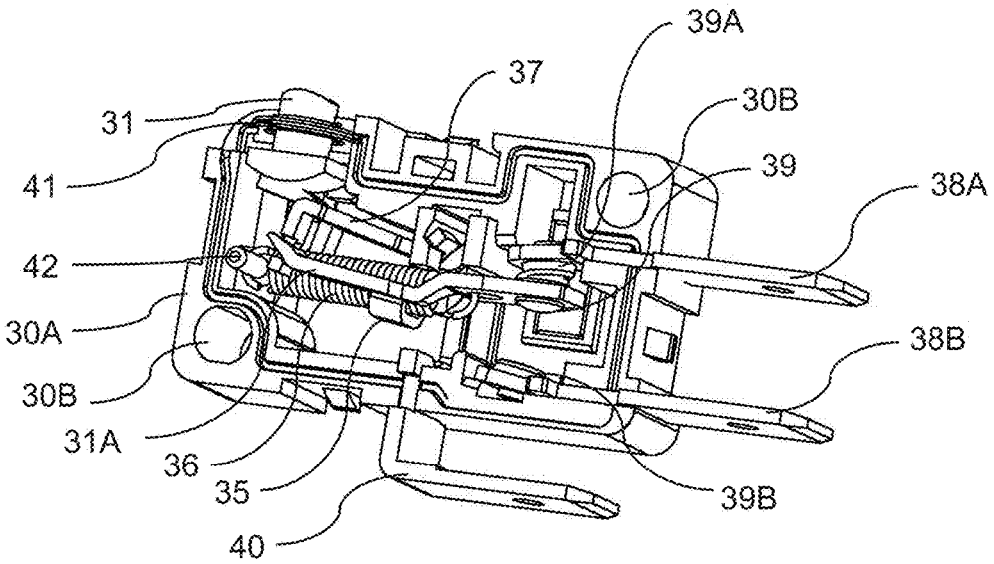
Figure 6A:
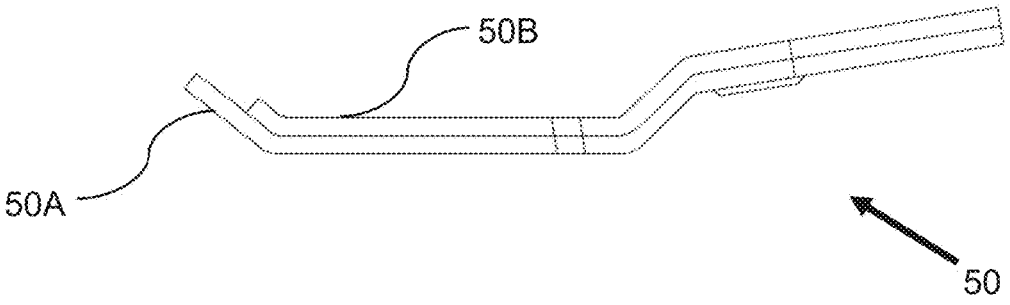
FIGS. 6A, 6B, 6C and 6D show a side-view, a front-view, a top perspective-view, and a bottom perspective-view respectively of an exemplary contact lever in accordance with another embodiment of the present invention in which the cross-section of the contact lever is thickened by joining two contact levers together.
Figure 6B:
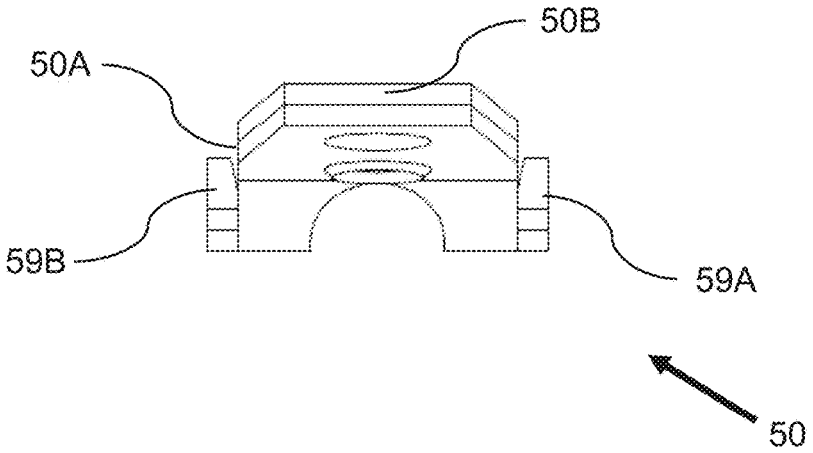
Figure 6C:
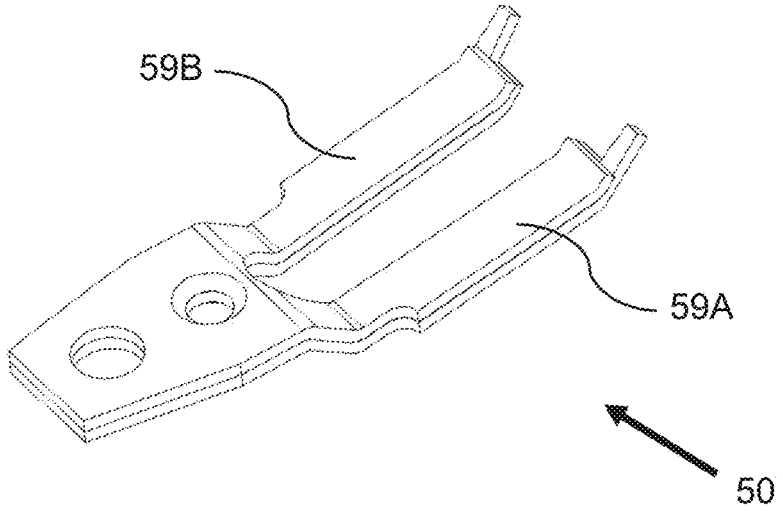
Figure 6D:
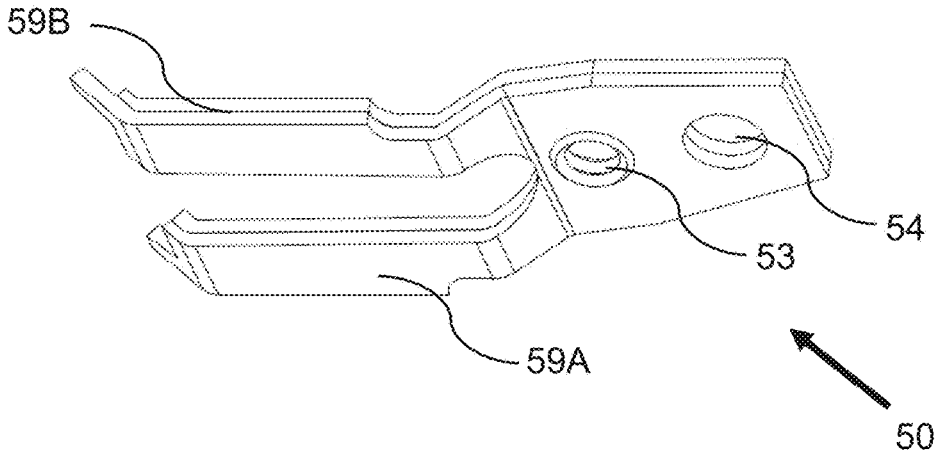
Figure 7A:
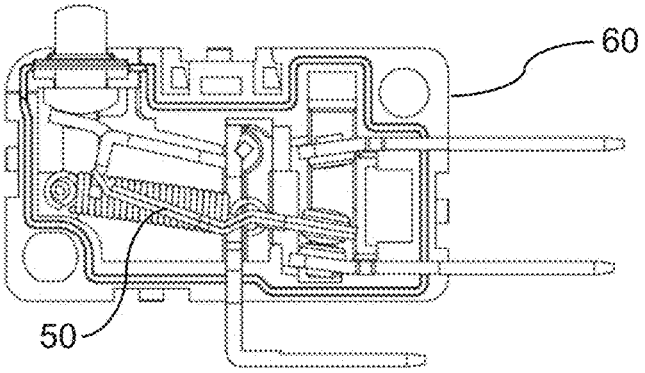
FIGS. 7A and 7 B shows a side-view of a microswitch assembly having the exemplary contact lever shown in FIG. 6A arranged in a first and a second position respectively.
Figure 7B:
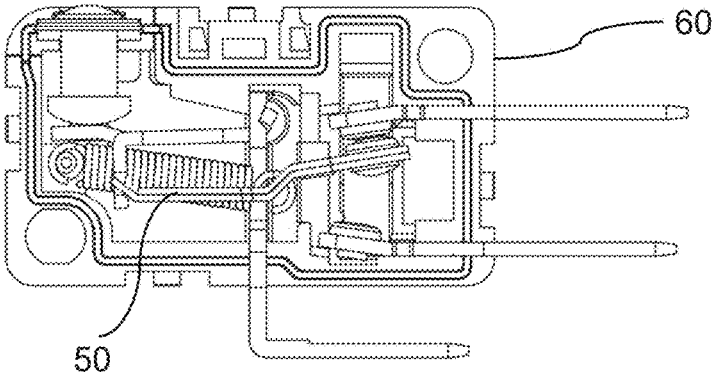

Referring now to FIGS. 3-5B, an embodiment of the present invention is shown which assists in alleviating the above problem. In this embodiment, a housing includes a main body (30A) and lid portion (30C) securable to the main body (30A) in order to house various components of the electrical switch assembly therein. The main body (30A) is moulded from any suitably robust material and is configured to seat the various components in suitable positions relative to one another so that they may operably-interact with other components during ordinary usage of the electrical switch assembly. The main body (30A) also includes a pair of mounting apertures (30B) to allow mounting of the housing within an electrical device. As shown in FIGS. 4, 5A and 5B, the electrical switch assembly includes a normally closed (NC) electrical terminal (38B) and a normally opened (NC) electrical terminal (38A) both seated in relation to the main body (30A) of the housing so that first ends of the respective electrical terminals (38A,38B) extend outwardly of the main body (30A) of the housing whist second ends of the electrical terminals (38A,38B) are located internally of the main body (30A) of the housing and have respective stationary contact members (39A,39B) affixed thereto for electrical communication with the movable contact (39) of the electrical switch assembly. The electrical switch assembly (30) of this embodiment also includes a common electrical terminal (40) that is configured for fixed electrical communication with the movable contact member (39) via the conductive contact lever.

A contact lever is also movably mounted within the main body (30A) of the housing about a hinge member. The contact lever is shown in stand-alone form in FIGS. 3A-3C and in the exploded view of an electrical switch assembly in FIG. 4 and in fully assembled form of the electrical switch assembly in FIGS. 5A and 5B. The contact lever includes first and second lever arms (31A,31B) that are connected at respective first ends to a contact member plate (32) upon which is securely mounted the movable contact member (39). The movable contact member (39) in this embodiment is configured for friction fitting into an aperture (34) formed in the contact member plate (32). The first and second lever arms (31A,31B) also have respective second ends, whereby the first and second lever arms (31A,31B) are configured to extend away from the contact member plate (32) and to terminate at their respective second ends. As shown in the FIG. 3, a gap (31C) is disposed between the first and second lever arms (31A,31B) which separates the first and second lever arms (31A,31B) as they extend away from the movable contact member (39).

The contact member plate (32) also includes a further aperture (33) configured for anchoring one end of the tension spring (36) (with the other end of the tension spring being anchored to a second fixed anchor point (42) moulded in the internal surface of the housing main body (30A)) such that in use the body of the tension spring (36) will freely be received within the gap (31C) when operably-connected with and during ordinary operation of the contact lever. In contrast to the prior art contact lever configuration described above, a bridge member (35) is configured for connecting the first and second lever arms (31A,31B) whereby it traverses the gap (31C) separating the first and second lever arms (31A,31B) and provides structural support for the contact lever. In particular, the bridge member (35) assists in alleviating deformation of the contact lever due to heat stress and/or mechanical stress applied to the material of the contact lever by substantially supporting the first and second lever arms in their fixed spaced-apart relationship. Furthermore, the novel inclusion of the bridge member (35) assists in providing a stronger overall structure for the contact lever which may assist in increasing overall production yield of such contact lever components during manufacture. In particular, in contrast to prior art contact levers described herein which may be relatively susceptible to breakage when stamped out during production due to their bridge-less structure, such problems are alleviated during stamping out due to the overall stronger and/or more rigid structure of the contact lever. Furthermore, as the novel inclusion of the bridge member (35) improves the overall strength of the contact lever structure, copper alloys (or any other suitable material known to persons skilled in the art) of lower stiffness may be utilised which tends to improve conductivity through the contact lever and thereby allows for higher current rating capability. Furthermore, in these embodiments of the present invention, the bridge member (35) is shaped and dimensioned in a substantially U-shaped configuration so as to not unduly block movement of the tension spring (36) within the gap (31C). Although in the embodiment shown in FIGS. 4-5 the bridge member (35) appears to extend on a lower side of the contact lever, it may also be located to extend above the contact lever and may also be positioned further along the lengths of the contact lever arms (31A,31B) away from the movable contact member (39) compared to as shown in the exemplary drawings, and may be of varying dimensions, depending upon the geometries of the other components within the electrical switch assembly. Furthermore, more than one bridge member (35) may also be utilised and such may also be shaped and located so as to not unduly block movement of the tension spring within the gap or to interfere with ordinary operation of other components within the electrical switch assembly.

The contact lever may typically be comprised by a conductive copper alloy material and the bridge member (35) may be either integrally formed with the contact lever, or, may be for instance welded to the contact lever arms (31A,31B) to connect the first and second lever arms (31A, 31B).

An actuator member (31) is also seated in relation to the main body (30A) of the housing so that it may be depressed inwardly of the main body (30A) by relatively small amount of force applied by the user's finger. A sealing ring (41) is also provided which assists in preventing ingress or dust and water into the housing (30A) via the opening in which the actuator (31) moves. FIG. 5A shows the contact lever arranged so that the movable contact (39) is in electrical communication with the stationary contact member (39B) of the NC electrical terminal (38B). Upon depression of the actuator (31), a yoke (37) and a tension spring (36) operably-connecting the actuator (31) to the contact lever, are configured to effect movement of the contact lever in a snap-action (or over-centre) type manner so that the movable contact member (39) mounted on the contact lever is moved from electrical communication with the stationary contact member (39B) of the NC electrical terminal (38B) as shown in FIG. 5A, into electrical communication with the stationary contact member (39A) of the NO electrical terminal (38A) as shown in FIG. 5B.

In certain embodiments, alternatively, or, in addition to a bridge member connecting the first and second lever arms of a contact lever, a contact lever (50) may be formed by bonding or joining together two or more separate contact levers (50A,50B). For instance, as shown in FIGS. 6A-6D (the contact lever in stand-alone fashion) and 7A-7B (the contact lever assembled in a microswitch device (60)), an example of such a contact lever (50) is shown formed by welding together the two separate contact levers (50A,50B) in multi-layered fashion whereby the resulting cross-sectional profile of the contact lever (50) is thickened by virtue of the layering. The contact levers (50A,50B) may also be bonded together by any suitable bonding or joining means apart from the use of welding and the separate contact levers (50A,50B), for instance by riveting. The separate contact levers (50A,50B) need not be identical in overall shape and dimensions however in this embodiment the separate contact levers (59A,59B) are formed so that the contact lever arms (59A,59B) and apertures (54,54) disposed in each of the contact levers (50A,50B) are suitably located so as to be in alignment when the separate contact levers (50A,50B) are bonded or joined together.

Furthermore, in yet further embodiments, instead of bonding or joining together two fully formed contact levers to increase the thickness and strength of the cross-sectional profile, it may be possible to bond or join together one or more alloy pieces to only specific regions of one contact lever so as to increase the cross-sectional thickness of only those specific regions (for instance, the lever arms (59A, 59B)) of the contact lever (50). By increasing the cross-sectional thickness of the contact lever (50) in this manner, this may also assist in alleviating deformation of the contact lever (50) due to heat stress and/or mechanical stress applied to the material of the contact lever (50).

Those skilled in the art will appreciate that the invention described herein is susceptible to variations and modifications other than those specifically described without departing from the scope of the invention. All such variations and modification which become apparent to persons skilled in the art, should be considered to fall within the spirit and scope of the invention as broadly hereinbefore described. It is to be understood that the invention includes all such variations and modifications. The invention also includes all of the steps and features, referred or indicated in the specification, individually or collectively, and any and all combinations of any two or more of said steps or features.

The reference to any prior art in this specification is not, and should not be taken as, an acknowledgment or any form of suggestion that prior art forms part of the common general knowledge.

What is claimed is:

1. A contact lever for use in an electrical switch assembly so as to allow selectable movement within the switch assembly of a contact lever contact member from electrical connection with a first stationary contact member into electrical connection with a second stationary contact member, the contact lever including:

first and second lever arms that are connected at respective first ends to the contact lever contact member and extend away from the contact member so as to terminate at their respective second ends;

a gap disposed between and separating the first and second lever arms, said gap extending substantially along entire lengths of the first and second lever arms wherein the gap is shaped and dimensioned to allow movement of a spring element of the switch assembly through the gap substantially along entire lengths of the lever arms; and a rigid bridge member configured for connecting with the first and second lever arms together at regions of the first and second lever arms between their respective first and second ends, wherein said rigid bridge member includes a substantially U-shaped curve that is shaped and dimensioned to receive a portion of the spring element therein when the spring element passes through the gap during operation of the switch assembly whereby the bridge member does not block movement of the spring element through the gap substantially along entire lengths of the lever arms.

2. A contact lever as claimed in claim 1 wherein the bridge member is configured for connecting the first and second lever arms at regions along the first and second lever arms so as to define an aperture between the bridge member and the contact lever contact member.

3. A contact lever as claimed in claim 1 including a contact lever contact member plate having at least one of a recess, aperture or abatement disposed therein configured for securement of the contact lever contact member thereto.

4. A contact lever as claimed in claim 1 including an aperture configured for securement with a first end of a tension spring of the switch assembly.

5. A contact lever as claimed in claim 1 wherein the bridge member includes a conductive material.

6. A contact lever as claimed in claim 1 wherein the bridge member includes a copper alloy material.

7. A contact lever as claimed in claim 1 wherein the bridge member is integrally formed with the first and second lever arms.

8. A contact lever as claimed in claim 1 where in the switch assembly includes a microswitch assembly.

9. An electrical switch assembly including a contact lever as claimed in accordance with claim 1.

* * * * *